United States Patent [19]

Hinz et al.

[11] Patent Number: 5,031,643

[45] Date of Patent: Jul. 16, 1991

[54] PNEUMATIC CONVEYOR FOR ROD-SHAPED ARTICLES OF THE TOBACCO PROCESSING INDUSTRY AND THEIR COMPONENTS

[75] Inventors: Werner Hinz, Lauenburg; Lothar Krause, Oststeinbek, both of Fed. Rep. of Germany

[73] Assignee: Körber AG, Hamburg, Fed. Rep. of Germany

[21] Appl. No.: 568,253

[22] Filed: Aug. 15, 1990

[30] Foreign Application Priority Data

Aug. 26, 1989 [DE] Fed. Rep. of Germany ..... 3928273

[51] Int. Cl.[5] ..... B65G 29/00; B65G 37/00

[52] U.S. Cl. ..... 131/94; 198/471.1; 198/473.1

[58] Field of Search ..... 131/94; 198/471.1, 473.1, 198/803.5

[56] References Cited

U.S. PATENT DOCUMENTS

| | | | |
|---|---|---|---|
| 3,137,302 | 6/1964 | Schubert | 131/94 |
| 3,164,242 | 1/1965 | Schubert et al. | 131/94 |
| 3,352,404 | 11/1967 | Settembrini | 198/689.1 |
| 3,564,902 | 2/1969 | Heitmann | 73/37 |
| 3,665,930 | 5/1972 | Giatti | 131/94 |
| 4,154,090 | 5/1979 | Heitmann | 73/38 |
| 4,262,680 | 4/1981 | Hinzmann | 131/94 |
| 4,596,257 | 6/1986 | Garthaffner et al. | 131/94 |
| 4,869,274 | 9/1989 | Berger | 131/94 |

FOREIGN PATENT DOCUMENTS 986454 3/1965 United Kingdom .

*Primary Examiner*—V. Millin
*Assistant Examiner*—Lynne A. Reichard
*Attorney, Agent, or Firm*—Peter K. Kontler

[57] ABSTRACT

A rotary drum which serves to transport rod-shaped articles of the tobacco processing industry or sheet-like components of such articles has a peripheral surface which is formed with rows of axially parallel suction ports connectable to a suction generating device to attract the articles or their components to the peripheral surface of the drum. If the lengthh of rod-shaped articles is changed, or if the width of web- or strip-shaped components of articles is changed, the effective length of the rows of suction ports is changed accordingly to avoid unnecessary flow of air into non-overlapped suction ports. The effective length of the rows of suction ports is varied in response to turning of apertured tubes which are inwardly adjacent the rows of suction ports and can be jointly turned to connect the suction generating device with a first group of ports in the respective row in first angular positions of the pipes and to connect the suction generating device with second groups of suction ports in second angular positions of the pipes.

14 Claims, 1 Drawing Sheet

PNEUMATIC CONVEYOR FOR ROD-SHAPED ARTICLES OF THE TOBACCO PROCESSING INDUSTRY AND THEIR COMPONENTS

BACKGROUND OF THE INVENTION

The invention relates to apparatus for transporting rod-shaped articles of the tobacco processing industry and/or their components. More particularly, the invention relates to improvements in apparatus for pneumatically transporting filter rod sections, plain or filter cigarettes, cigars or cigarillos as well as cigarette paper, tipping paper, filter paper and blanks of paper or other material for use in the making of packets for cigarettes and the like.

It is customary to transport rod-shaped articles of the tobacco processing industry and their components on drum-shaped rotary conveyors which are formed with suction ports to attract the conveyed objects. Connection with a stationary suction generating device (e.g., a fan or a suction pump) is established by way of a stationary valve plate which abuts one axial end of the body of the rotating drum-shaped conveyor. If the objects to be transported are rods (e.g., plain or filter cigarettes, cigars or cigarillos, filter rod sections, tubular shells of paper or the like), the peripheral surface of a rotary suction drum is normally formed with axially parallel flutes which receive portions of or even the entire rod-shaped articles, and the suction ports are machined into those surfaces of the drum-shaped conveyor which surround the flutes. The peripheral surface of a rotary drum-shaped conveyor is a smooth cylinder if the conveyor is used to transport continuous webs or strips of cigarette paper, filter paper, tipping paper or other wrapping material as well as if the conveyor is used to transport discrete sections of strips or webs, e.g., individual blanks of paper, foil or cardboard in a cigarette packing machine or individual sections of tipping paper in filter tipping machines wherein plain cigarettes are united with filter plugs to form filter cigarettes of unit length or multiple unit length.

The suction ports of a conventional rotary suction drum are substantially radially disposed holes or bores which extend from the peripheral surface to axially parallel bores extending to one end face of the drum body to be connected with a suction generating device, at least during one or more stages of each revolution of the drum. As mentioned above, the suction ports are normally disposed in rows extending in parallelism with the axis of the suction drum, and the length of each row of suction ports is related to the length of rod-shaped articles or to the width of sheet-like objects which are to be transported by the drum. Consequently, if a suction drum is designed to transport relatively short rod-shaped articles (which are parallel to the axis of the drum) or to transport relatively narrow strips of cigarette paper or the like, such drum cannot be used for the transport of longer articles (e.g., plain cigarettes of double unit length) or for the transport of relatively wide strips or webs. Therefore, it is often necessary to employ relatively long drums for the transport of short rod-shaped articles or for the transport of relatively narrow strips or webs because this ensures that the same drum can be used for the transport of longer rod-shaped articles or wider webs or strips.

A drawback of a drum-shaped conveyor wherein the length of rows of suction ports exceeds the length of rod-shaped articles or the width of strip-shaped commodities is that certain suction ports remain exposed when the conveyor is in use. Streams of air which flow into exposed suction ports are likely to entrain solid contaminants (such as minute fragments of cigarette paper and/or minute fragments of tobacco) which clog the passages between the ports and the suction generating device. Another drawback of air streams which are free to flow into exposed suction ports is that they generate considerable noise.

In order to avoid the above outlined drawbacks of relatively long drum-shaped penumatic conveyors, it is customary to seal those suction ports which would remain exposed if the conveyor were used for the transport of relatively short rod-shaped articles of for the transport of relatively narrow strips of webs of paper or the like. This involves much work and prolongs the intervals of idleness of the machine in which the conveyor is put to use. In accordance with another known proposal, a relatively long drum-shaped conveyor is replaced with a shorter conveyor if the transport of a series of relatively long articles or wide webs is to be followed with the transport of a series of shorter articles or narrower webs. This, too, takes up much time and renders it necessary to maintain a supply of spare conveyors which contributes significantly to the initial cost of a cigarette maker, filter tipping machine, cigarette packing machine or any other machine which is used for the processing of smokers' products.

OBJECTS OF THE INVENTION

An object of the invention is to provide a novel and improved apparatus which can pneumatically transport rod-shaped articles of the tobacco processing industry and their components and is constructed and assembled in such a way that it can transport shorter or longer rod-shaped articles or wider or narrower sheet-like objects without drawing streams of air into its suction ports.

Another object of the invention is to provide a novel and improved drum-shaped conveyor for use in the above outlined apparatus.

A further object of the invention is to provide an apparatus wherein the rotary drum-shaped conveyor can be rapidly converted for the transport of shorter or longer rod-shaped articles or for the transport of wider or narrower strips, webs or sections of sheet-like material.

An additional object of the invention is to provide the apparatus with novel and improved means for regulating the connections between the suction ports in the peripheral surface of a rotary drum-shaped conveyor and a suction generating device.

Still another object of the invention is to provide an apparatus wherein the conversion from transport of longer articles to transport of shorter articles or vice versa, or from transport of wide sheet-like objects to transport of narrower sheet-like objects or vice versa, can be completed instantaneously and, if desired, in a fully automatic way.

A further object of the invention is to provide a machine which employs one or more apparatus of the above outlined character.

An additional object of the invention is to provide an apparatus wherein the passages for the flow of air are less likely to be contaminated and clogged than in heretofore known apparatus.

Another object of the invention is to provide an apparatus whose operation is quieter than that of heretofore known apparatus.

A further object of the invention is to provide an apparatus which can be installed in existing tobacco processing and related machines as a superior substitute for heretofore known apparatus.

Another object of the invention is to provide a novel apparatus for severing webs of cigarette paper, filter paper, tipping paper or other wrapping material.

SUMMARY OF THE INVENTION

The invention is embodied in a pneumatic apparatus for transporting objects which include rod-shaped articles of the tobacco processing industry (such as cigarettes, cigarillos or cigars with or without filters and filter rod sections) and their components (such as cigarette paper, filter paper, tipping paper and blanks for the making of packets for rod-shaped articles of the tobacco processing industry). The improved apparatus comprises a suction generating device, a conveyor which serves to advance objects in a predetermined direction and has an object-contacting surface as well as an array of suction ports which are provided in the surface and can be connected with the suction generating device to establish a pressure differential at opposite sides of objects which overlie the ports while being in contact with the surface to be transported in the predetermined direction, and adjusting means for varying or changing the effective width of the array of suction ports as seen transversely of the predetermined direction. Thus, and if the conveyor is to transport webs or strips of paper or the like, the effective width of the array of suction ports will be reduced for the transport of relatively narrow strips or webs but will be increased for the transport of wider strips or webs.

The conveyor is preferably a rotary conveyor having a preferably cylindrical or substantially cylindrical peripheral surface which constitutes the object-contacting surface.

The adjusting means can comprise means for connecting selected ports of the array of ports to and for disconnecting selected ports of the array from the suction generating device. The array preferably comprises rows of suction ports, and the connecting means can comprise a discrete connecting or control member for each row of suction ports. The connecting means preferably further comprises means for moving each connecting member between a first position in which the suction generating device is connected with a first group of ports in the respective row, and at least one second position in which the suction generating device is connected with a different second group of ports in the respective row. The rows can extend substantially transversely of the predetermined direction.

The moving means can comprise means for simultaneously moving at least some (e.g., all) of the connecting or control members between their first and second positions.

Each connecting or control member can comprise a pipe which is connected to the suction generating device and has first and second sets of openings. The moving means includes means for moving (preferably turning) the pipes between first positions in which the openings of the first sets communicate with the first groups of ports in the respective rows, and second positions in which the openings of the second sets communicate with the second groups of ports in the respective rows. If the pipes are turnable between their first and second positions, the openings of the first sets are preferably offset with reference to the openings of the second sets in the circumferential direction of the respective pipes.

The peripheral surface of the rotary conveyor can be a smooth surface, and the rows of suction ports can be at least substantially parallel to the axis of the rotary conveyor. The adjusting means can include means for varying the effective width of the array of suction ports in a plurality of stages, e.g., in the aforedescribed two stages or in more than two stages.

The rotary conveyor can constitute a drum. The peripheral surface of such drum can be used to transport sheet-like objects, and the drum can cooperate with means (e.g., a rotary cutting drum having one or more radially outwardly extending knives) for severing sheet-like objects on the peripheral surface.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
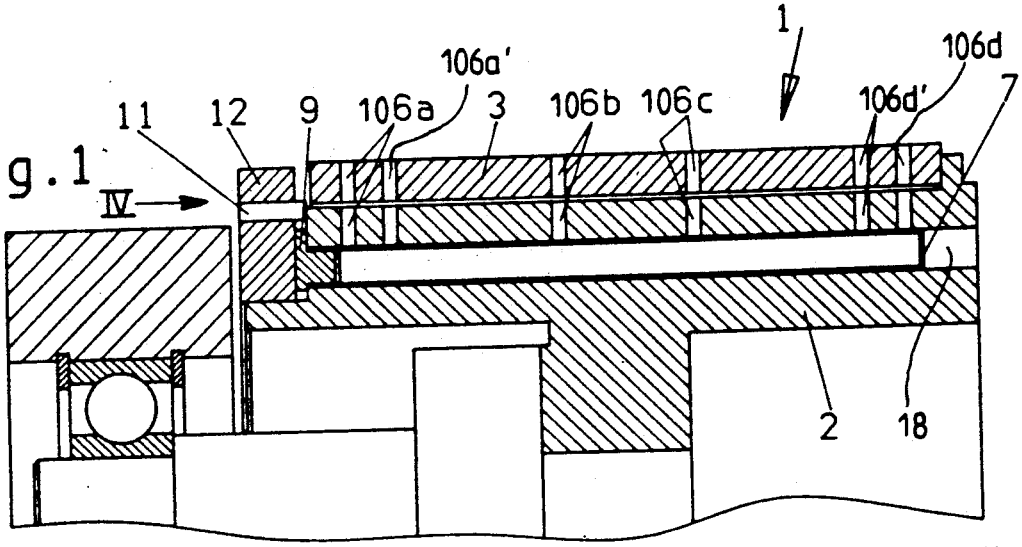
FIG. 1 is a fragmentary axial sectional view of a drum-shaped rotary conveyor which forms part of the improved apparatus.

FIG. 1 shows a rotary drum-shaped conveyor 1 which is drawn to a larger scale (approximately two-to-one) for the sake of clarity. This conveyor forms part of an apparatus which severs a web of tipping paper in a filter tipping machine. Reference may be had, for example, to FIG. 1 of commonly owned U.S. Pat. No. 4,262,680 to Hinzmann where a rotary drum-shaped conveyor is shown at 19, a web of tipping paper is shown at 13, and a rotary knife drum which cooperates with the conveyor 19 to repeatedly sever the leader of the web 13 is shown at 21.

The conveyor 1 comprises a drum-shaped body 2 of steel and a hollow cylinder 3 which surrounds the body 2 and is made of a very hard (e.g., sintered) material so that it can withstand repeated impacts of the cutting edges of knives on the associated rotary knife drum when the apparatus including the conveyor 1 is in use. The cylinder 3 has a smooth cylindrical peripheral surface 15 (FIG. 3), and the direction of rotation of the conveyor 1 (i.e., the direction of advancement of objects with the peripheral surface 15) is indicated by arrow 4. The peripheral surface 15 is provided with several rows of suction ports 106, and such rows extend in substantial parallelism with the axis of rotation of the conveyor 1, i.e., substantially transversely of the direction which is indicated by the arrow 14. The ports 106 enable the surface 15 to attract and entrain the leader of the web of tipping paper as well as to attract and entrain successively formed sections of the web. Such sections are obtained in response to repeated severing of the leader of the web. Reference may also be had to U.S. Pat. No. 3,137,302 to Schubert which shows a modified drum-shaped conveyor and a rotary knife-carrying drum for subdivision of a web of tipping paper into discrete sections serving to connect plain cigarettes with filter mouthpieces of desired length. A further drum shaped conveyor with suction ports is shown in British Pat. No. 986,454.

Figure 2:
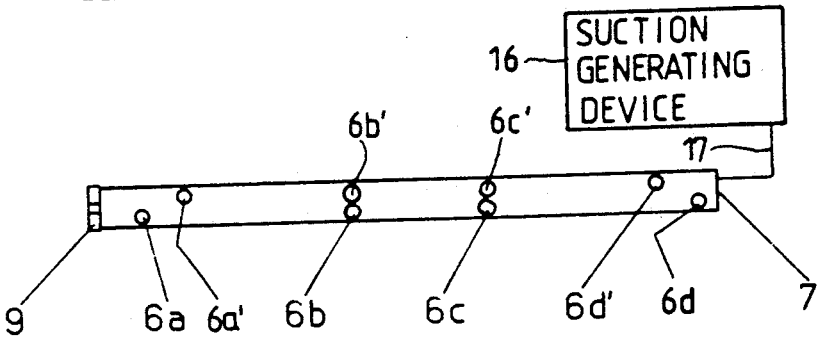
FIG. 2 is an elevational view of a tubular connecting or control member of the means for adjusting the effective width of the array of suction ports in the peripheral surface of the conveyor.
Figure 3:
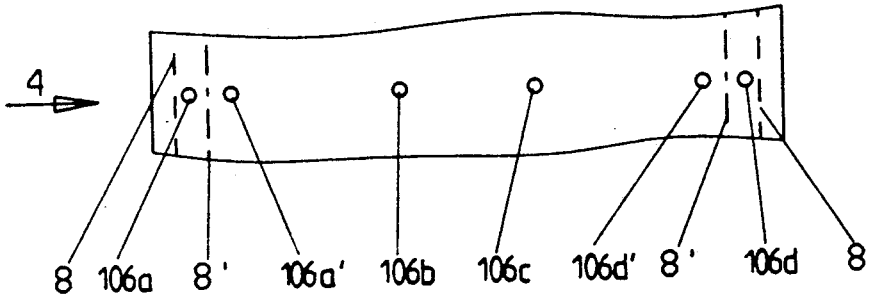
FIG. 3 is a fragmentary developed view of the peripheral surface of the conveyor.

The suction ports 106 of each row extend radially through the entire cylinder 3 as well as into the adjacent outermost portion of the drum-shaped body 2. Each such port is a round hole or bore (FIG. 3). The body 2 has axially parallel channels 18, one for each row of ports 106. Each channel 18 snugly receives an elongated control or connecting member 7 (hereinafter called pipe for short) which is turnable in the respective channel between at least two predetermined angular positions. The right-hand end (as seen in FIG. 1) of each pipe 7 is open so that it can be connected to the suction intake of a stationary suction generating device 16 (FIG. 2) which can constitute a fan, a suction pump or any other means capable of drawing air from the internal spaces of the pipes 7. The reference character 17 denotes an operative connection between the illustrated pipe 7 and the suction generating device 16. The connection can include a conventional stationary valve plate which is adjacent and sealingly engages the right-hand end face of the drum-shaped body 2 and has one or more arcuate grooves which communicate with selected channels 18, either continuously or during one or more stages of each revolution of the conveyor 1. The groove or grooves are connected to the intake of the suction generating device. Reference may be had to U.S. Pat. No. 3,564,902 to Heitmann wherein a valve plate is shown in FIG. 2, as at 32, and its groove is shown at 33. Reference may also be had to FIG. 2 of U.S. Pat. No. 4,154,090 to Heitmann et al. wherein a valve plate is shown at 68 and its groove at 69.

The suction ports 106 of the rows together form an array of ports which extends circumferentially of the conveyor 1 as well as axially close to both axial ends of the drum-shaped body 2 and cylinder 3. The maximum width of the array of ports 106 is selected with a view to ensure predictable retention and transport of a relatively wide web or strip 8 (indicated in FIG. 3 by broken lines), namely a web which is sufficiently wide to overlie all ports 106 of those rows wherein the outer ends of ports 106 are immediately adjacent the respective side of the web 8. The other (non-overlapped ports 106 are sealed from the suction generating device 16 as a result of appropriate selection of the groove or grooves in the aforediscussed valve plate adjacent the right-hand end face of the drum-shaped body 2. However, if the relatively wide web 8 is replaced with a narrower web (indicated in FIG. 3 by phantom lines, as at 8'), the two outermost ports **106*a*, 106*d* of each row remain exposed and, in the absence of any undertaking to the contrary, are free to draw atmospheric air into the interior of the cylinder 3 and drum-shaped body 2. This would result in rapid contamination of the paths for the flow of air to the suction generating device 16** and would generate much noise, especially in a machine (such as a filter tipping machine) which is designed to turn out many thousands of rod-shaped articles per minute.

Figure 4:
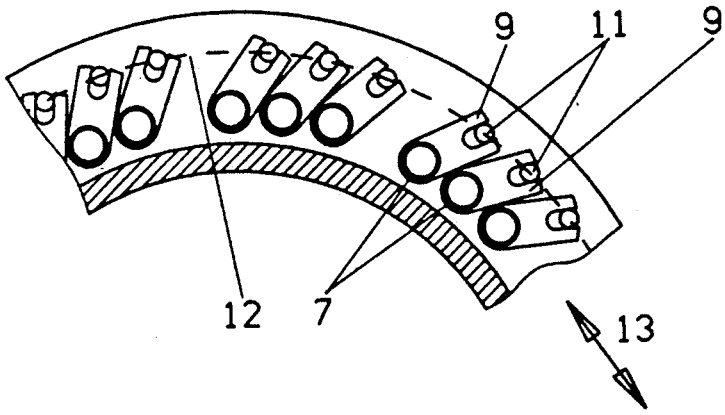
FIG. 4 is a fragmentary end elevational view of the conveyor as seen in the direction of arrow IV in FIG. 1.

In accordance with a feature of the invention, the pipes 7 form part of an adjusting unit which is designed to connect the suction generating device 16 with a first group of ports (**106*a*, 106*b*, 106*c*, 106*d*) in each row when the conveyor 1 is to transport a wide web 8, and with a second group of ports (106*a'*, 106*b*, 106*c*, 106*d'*) of each row when the conveyor 1 is to transport a narrower web 8'. To this end, each pipe 7 has a first set of openings 6*a*, 6*b*, 6*c*, 6*d* which register with the ports 106*a*, 106*b*, 106*c*, 106*d* of the respective row in a first angular position of the pipe 7, and a second set of openings 6*a'*, 6*b'*, 6*c'*, 6*d'* which communicate with the ports 106*a'*, 106*b*, 106*c*, 106*d'* of the respective row in a different second angular position of the pipe. The adjusting or connecting means further comprises means for moving (turning) the pipes 7 between their first and second angular positions. As shown in FIGS. 1, 2 and 4, the moving means comprises a radially extending bifurcated arm 9 affixed to the sealed left-hand end of each pipe 7, a ring 12 which is rotatably mounted on the adjacent end portion of the drum-shaped body 2, and motion transmitting pins 11 which are provided on the ring 12 and extend into the slots between the prongs of the adjacent arms 9. The ring 12 can be rotated (within limits) relative to the conveyor 1 in directions which are indicated by the double-headed arrow 13 of FIG. 4**.

When moved in one direction, the ring 12 causes all of the pipes 7 to assume angular positions in which one set of their openings registers with the ports of one group of ports in the respective rows. When moved in the opposite direction, the ring 12 causes all of the pipes 7 to assume the other angular positions in which the other set of their openings registers with the ports of the other group of ports in the respective row. Thus, it is not necessary to plug or otherwise seal the ports **106*a*, 106*d* when the conveyor 1 is to transport a narrow web 8', and it is not necessary to unseal these ports when the conveyor 1 is to transport a wider web 8**. The conversion can be completed instantaneously and automatically, e.g., in response to a signal from a detector which monitors the width of the convoluted web of tipping paper in the filter tipping machine.

It is clear that the pipes 7 can be provided with three or even more sets of openings if the effective width of the arrays of suction ports 106 is to be varied in three or more stages, i.e., if such effective width is to assume three or more different values. Furthermore, the number of suction ports 106 in each row can greatly exceed the number which is shown in FIGS. 1 and 3. It will be noted that the openings **6*a*, 6*b*, 6*c*, 6*d* of one of the two sets of openings shown in FIG. 2 are staggered relative to the openings 6*a'*, 6*b'*, 6*c'*, 6*d'* of the other set of openings in the circumferential direction of the pipe 7. This is due to the fact that, in the illustrated embodiment of the improved apparatus, the pipes 7** are turned between their first and second positions.

It is further clear that the invention can be embodied with equal or similar advantage in apparatus wherein the conveyor is designed to transport articles or objects in the form of plain or filter cigarettes or other rod-shaped smokers' products. Such conveyor can be formed with axially parallel peripheral flutes and the rows of suction ports are machined into or otherwise formed in those surfaces which surround the flutes. A change in the effective width of the array of suction ports in such fluted conveyor will be necessary when the conveyor is to begin with the transport of rod-shaped articles which are shorter than the previously transported articles so that, in the absence of a change in the effective width of the array of suction ports, the suction generating device would be free to draw streams of air into those suction ports which are not overlapped by the rod-shaped articles in the respective flutes. Conversion back to the original condition will be necessary if the transport of shorter articles is to be followed by the conveying of longer articles which can be properly retained only if each thereof overlies a relatively long row of suction ports.

The surfaces surrounding the channels 18 in the drum-shaped body 2 of the conveyor 1 seal those openings which are not aligned with the suction ports in the adjacent row. This prevents the suction generating device 17 from drawing air into the inactive openings.

An important advantage of the improved apparatus is that the conveyor generates little noise. In addition, the suction ports are less likely to be clogged than in conventional apparatus. Still further, a change of the format (effective width of the array of suction ports) can be completed instantaneously and, if desired, in a fully automatic way. Moreover, it is not necessary to furnish the apparatus with one or more spare conveyors.

Without further analysis, the foregoing will so fully reveal that gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Pneumatic apparatus for transporting objects including rod-shaped articles of the tobacco processing industry and their components, comprising a conveyor arranged to advance objects in a predetermined direction and having an object-contacting surface and an array of suction ports in said surface, said ports being connectable to a suction generating device and being arranged to establish a pressure differential at opposite sides of objects which overlie the ports while being in contact with said surface to be transported in said direction; and adjusting means for varying the effective width of said array transversely of said direction.

2. The apparatus of claim 1, wherein said conveyor is a rotary conveyor having a peripheral surface which constitutes said object-contacting surface.

3. The apparatus of claim 2, wherein said adjusting means comprises control means for connecting selected ports of said array to and for disconnecting selected ports of said array from the suction generating device.

4. The apparatus of claim 3, wherein said array has rows of suction ports and said control means comprises a discrete control member for each row of suction ports.

5. The apparatus of claim 4, wherein said control means further comprises means for moving each control member between a first position in which the suction generating device is connected with a first group of ports in the respective row and at least one second position in which the suction generating device is connected with a different second group of ports in the respective row.

6. The apparatus of claim 5, wherein said rows extend substantially transversely of said direction.

7. The apparatus of claim 5, wherein said moving means comprises means for simultaneously moving at least some of said control members between said first and second positions thereof.

8. The apparatus of claim 5, wherein each of said control members includes a pipe connected to the suction generating device and having a first set of openings and a second set of openings, said moving means including means for moving said pipes between first positions in which the openings of the first sets communicate with said first groups of ports in the respective rows and second positions in which the openings of the second sets communicate with said second groups of ports in the respective rows.

9. The apparatus of claim 8, wherein the openings of said first sets are offset with reference to the openings of said second sets in the circumferential directions of the respective pipes.

10. The apparatus of claim 9, wherein said moving means includes means for turning the pipes between said positions thereof.

11. The apparatus of claim 2, wherein said peripheral surface is smooth and said array has rows of suction ports, said rows being substantially parallel to the axis of said rotary conveyor and said adjusting means including means for varying the effective width of said array in a plurality of stages.

12. The apparatus of claim 11, wherein said rotary conveyor is a drum.

13. The apparatus of claim 1, wherein said conveyor is a rotary conveyor having a peripheral surface which constitutes said object-contacting surface and is arranged to transport sheet-like objects.

14. The apparatus of claim 1, further comprising means for severing sheet-like objects on said peripheral surface.

* * * * *